US006742872B2

(12) United States Patent
Fukazawa et al.

(10) Patent No.: US 6,742,872 B2
(45) Date of Patent: Jun. 1, 2004

(54) INK JET RECORDING APPARATUS AND INK TANK MOUNTED ON SUCH INK JET RECORDING APPARATUS

(75) Inventors: Hideo Fukazawa, Kanagawa-ken (JP); Nobuyuki Hatasa, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/814,999

(22) Filed: Mar. 23, 2001

(65) Prior Publication Data

US 2001/0026301 A1 Oct. 4, 2001

(30) Foreign Application Priority Data

Mar. 31, 2000 (JP) ..... 2000-097621

(51) Int. Cl.[7] ..... B41J 2/01
(52) U.S. Cl. ..... 347/50
(58) Field of Search ..... 347/50, 49, 85, 347/86, 87

(56) References Cited

U.S. PATENT DOCUMENTS

| | | | | |
|---|---|---|---|---|
| 4,760,409 A | | 7/1988 | Kiyohara et al. | 347/86 |
| 4,878,069 A | * | 10/1989 | Kiyohara | 347/86 |
| 6,022,101 A | | 2/2000 | Sabonis | 347/84 |
| 6,130,695 A | * | 10/2000 | Childers et al. | 347/85 |
| 6,203,147 B1 | | 3/2001 | Battey et al. | 347/86 |
| 6,231,173 B1 | * | 5/2001 | Pawlowski et al. | 347/86 |

FOREIGN PATENT DOCUMENTS

| | | |
|---|---|---|
| DE | 197 48 914 | 8/1998 |
| EP | 763432 | 3/1997 |
| EP | 963847 | 12/1999 |
| WO | 85/00454 | 1/1985 |
| WO | 98/55318 | 12/1998 |
| WO | 99/59823 | 11/1999 |

* cited by examiner

*Primary Examiner*—Michael Nghiem
(74) *Attorney, Agent, or Firm*—Fitzpatrick, Cella, Harper & Scinto

(57) ABSTRACT

A recording apparatus is arranged to mount on the main body thereof an ink tank provided with a component of electrical conduction and an ink supply port, and structured to make ink supply and electrical connection possible. With the structure thus arranged, the adhesion of ink to the electric contacts is prevented in order to secure the reliability of electrical connection. The contacts are arranged on the side opposite to the hollow needle with a supporting member of a connector that supports plural contacts on the connector as reference.

6 Claims, 6 Drawing Sheets

INK JET RECORDING APPARATUS AND INK TANK MOUNTED ON SUCH INK JET RECORDING APPARATUS

BACKGROUND OF THE INVENTION

1. Field of the Invention

The present invention relates to an ink jet recording apparatus arranged to mount an ink tank, and provided with a component of electrical conduction and an ink supply port. The invention also relates to such ink tank.

2. Related Background Art

For an ink tank detachably mountable on an ink jet recording apparatus main body, it is often provided with an ink supply port on the lower part in the gravitational direction for supplying ink to the main body side. Then, an hollow needle, which is fixed on the ink tank mounting position of the apparatus main body, penetrates a rubber plug provided for the ink supply port of the ink tank when the ink tank is mounted, thus supplying ink to the ink jet recording head installed on the apparatus main body.

Also, for the color printer that uses ink of plural colors or the like, an ink tank itself holds, in some cases, information characteristic of the ink tank, such as the colors and kinds of ink or each amount of contents. Here, on the position where the ink tank is mounted, the connector having contacts provided therefor is made detachably mountable to face the component of electrical conduction arranged on the ink tank side, is installed in order to transmit such information held by the ink tank to the apparatus main body side as electrical information when the ink tank is mounted on the apparatus main body.

However, for the color printer that requires a plurality of ink tanks, the shape of each ink tank is configured to be flat in many cases for the ultimate implementation of a smaller recording apparatus. As a result, it is usually practiced to arrange in the longitudinal direction of ink tanks the relative positions of the connectors in series on the main body side. Here, for that matter, plural numbers of contacts and ink supply ports of the ink tanks are needed on the ink tank mounting surface which is the ink tank installation location on the main body. In such a case, the contacts of each ink tank, which are nearest to the ink supply port, are often stained by ink splash or the like from the tip hole of the hollow needle when attaching or detaching the ink tank. Eventually, therefore, the reliability of contacts is made insufficient as electrical contacts.

Also, both the ink tank mounting surface where the connector is arranged, and the surface of the ink tank mounted on that mounting surface, are substantially flat to each other. Consequently, the ink that has leaked from the tip hole of the hollow needle serving as an ink outlet port tends to flow to the connector side. Assumably, then, this may cause defective contact or short circuit to occur in some cases.

SUMMARY OF THE INVENTION

In consideration of the problems of the conventional art discussed above, the present invention is designed. It is an object of the invention to provide an ink jet recording apparatus capable of securing reliability of electrical conduction between the ink tank side and the main body side when an ink tank having a component of electrical conduction and an ink supply therefor is mounted on the ink jet recording apparatus main body, as well as to provide an ink tank to be mounted on such ink jet recording apparatus.

It is another object of the invention to provide an ink jet recording apparatus in which when an ink tank having a component of electrical conduction and an ink supply port is mounted on the ink jet recording apparatus main body, contacts are arranged on the side opposite to the ink outlet port on the main body side to draw ink from an ink supply port with a supporting member for supporting a plurality of contacts on a connector on the main body side as reference, as well as to provide an ink tank to be mounted on such ink jet recording apparatus.

It is still another object of the invention to provide an ink jet recording apparatus having a connector arranged above an ink outlet port on the main body side in the gravitational direction for drawing ink from an ink supply port when an ink tank provided with a component of electrical conduction and an ink supply port is mounted on the ink jet recording apparatus main body, as well as to provide an ink tank to be mounted on such ink jet recording apparatus.

It is a further object of the invention to provide an ink jet recording apparatus capable of preventing defective contact or short circuit from being caused to occur even if ink splashes from the ink supply port or ink outlet port toward the contact or the component of electrical conduction or even if ink leaks from the ink supply port or ink outlet port when an ink tank, which is provided with the component of electrical conduction and ink supply port, is attached to or detached from the main body for mounting or removal by arranging the structure so as to check such ink splash not to adhere or enable such leakage of ink to flow in the direction toward the connector, as well as to provide an ink tank to be mounted on such ink jet recording apparatus.

It is still a further object of the invention to provide an ink jet recording apparatus having a component of electrical conduction and an ink supply port for recording by discharging ink supplied from an ink tank to an ink jet recording head, which comprises a mounting surface for mounting ink tank; a connector arranged for the mounting surface, the connector being provided with electric contact electrically conductible with the component of electrical conduction of the ink tank mounted on the mounting surface; an ink outlet port arranged on the mounting surface, the ink outlet port being communicated with the ink outlet port of the ink tank mounted on the mounting surface; and an electric contact supporting unit arranged for the connector for supporting the electric contact, at the same time, lying between the electric contact and the ink outlet port on the mounting surface.

Further, it is another object of the invention to provide an ink tank mounted on the ink tank mounting surface of an ink jet recording apparatus for recording by use of an ink jet recording head, having an ink outlet port, an electric contact, and a connector provided with an electrical contact supporting member laying between the electric contact and the ink outlet port for supporting the electric contact, and arranging the electric contact to be above the ink outlet port in the gravitational direction, which comprises an ink container for containing ink to be used for recording; an ink supply port for supplying ink in the ink container to the ink jet recording apparatus side by communicating with the ink outlet port when mounted on the mounting surface; and a component of electrical conduction to obtain electrical conduction with the electric contact when mounted on the mounting surface.

DETAILED DESCRIPTION OF THE PREFERRED EMBODIMENTS

Hereinafter, with reference to the accompanying drawings, the description will be made of the embodiment in accordance with the present invention.

At first, the entire structure of an ink jet recording apparatus will be described in accordance with one embodiment of the present invention.

Figure 1:
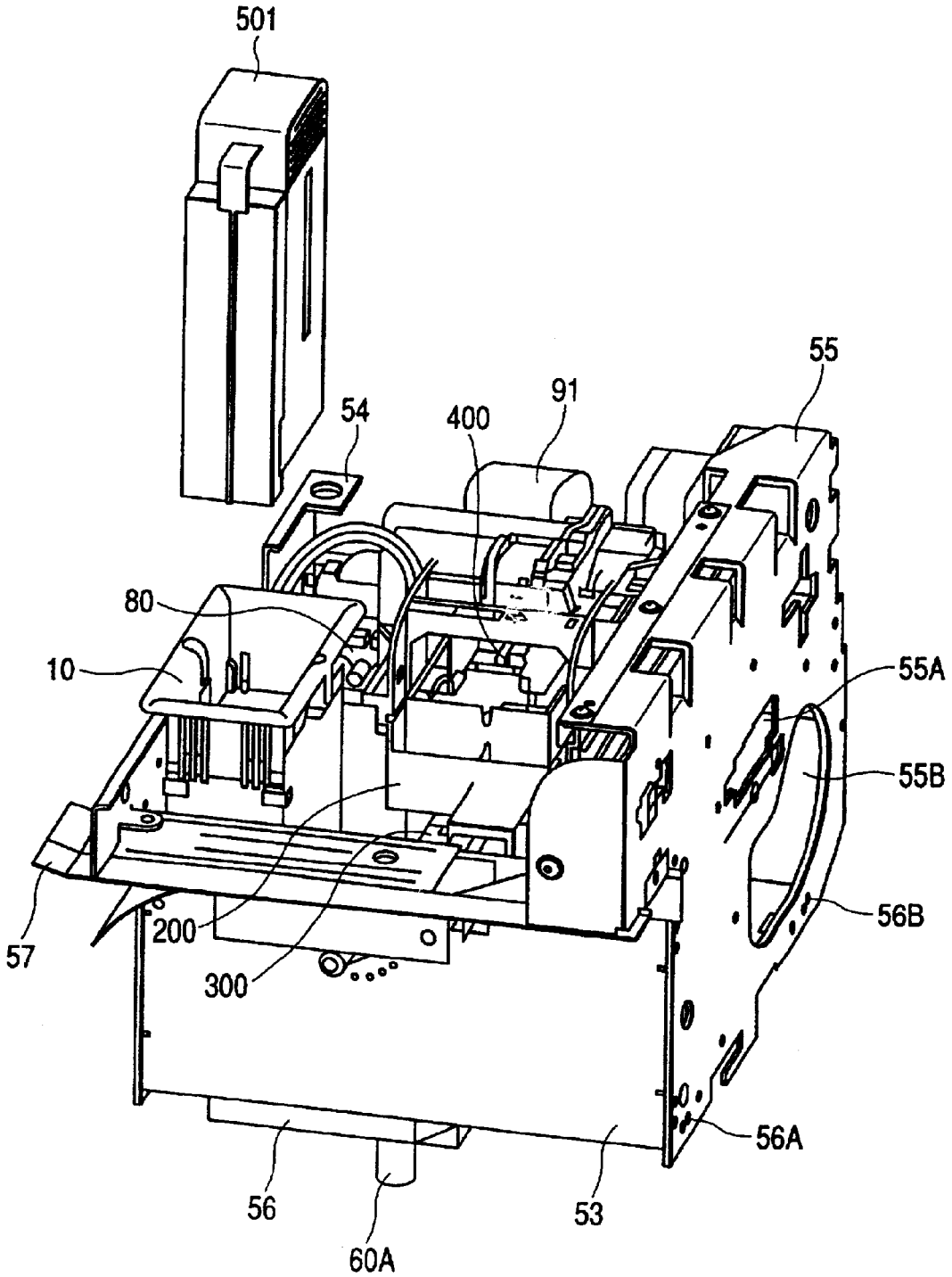
FIG. 1 is a right front perspective view which schematically shows the structure of an ink jet recording apparatus in accordance with one embodiment of the present invention.
Figure 2:
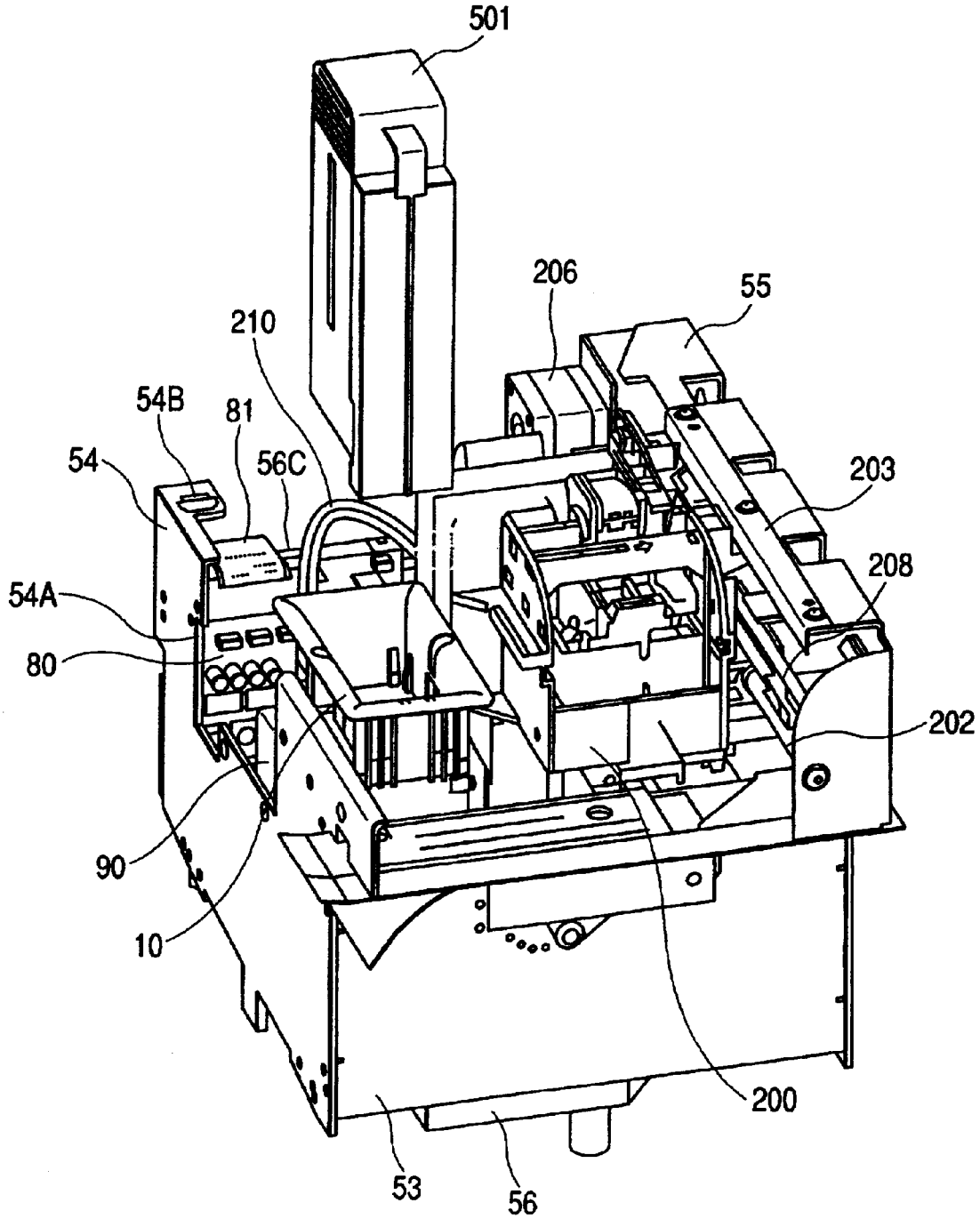
FIG. 2 is a left front perspective view which schematically shows the structure of the ink jet recording apparatus in accordance with one embodiment of the present invention.

The ink jet recording apparatus of the mode shown in FIG. 1 and FIG. 2 is a recording apparatus provided with recording function, which is detachably mountable on a main body printing machine (not shown) for recording continuously designated recording patterns on plural recording positions fixed on two kinds of recording mediums, such as an envelope and a continuous paper sheet capable of being cut arbitrarily. Here, FIG. 1 is a right front perspective view, and FIG. 2 is left front perspective view of such apparatus.

The structure of this recording apparatus is roughly divided into the units given below. In other words, these are: a recording head unit for recording by discharging ink; a carriage unit for moving the recording head to a recording position and to a standby position as required; an ink supply unit for supplying ink to the recording head, and a detachably mountable ink tank; a recovery unit for maintaining the discharge performance of the recording head or for recovering it; a frame unit for housing each of the aforesaid units; and a power-supply unit for supplying electric power to electrical components or the like on each portion of the recording apparatus. In this respect, the recording head is the one that records by discharging liquid from fine openings by providing energy for liquid in flow paths by means of electrothermal converting devices, piezoelectric devices, or the like.

Of the aforesaid units, the frame unit will be described at first.

Referring to FIG. 1 and FIG. 2, a bottom plate 56 is the metallic plate which is bent substantially in the L-letter shape to form the bottom portion and the rear portion, and on the bottom portion, there are arranged parallel abutting portions (not shown) on several locations for keeping a designated distance between each of them on the left and right sides, and also, positioning extrusions 56A and 56B on both ends of the bottom portion, as well as threaded portions on plural locations, respectively. On the left plate 54 and the right plate 55, each of the positioning holes is arranged, into which each of the positioning extrusions 56A and 56B is inserted. Then, in a state of being inserted, both of them are threaded into the threaded holes on the bottom plate 56 up to the aforesaid abutting portions on the bottom plate 56. Thus, with the bottom plate 56 as a central stay, the left and right side plates 54 and 55 are incorporated in parallel. Also, facing the rear portion 56C which rises in a substantially L-letter form, a front plate 53 is held by means of screws between the left and right side plates 54 and 55. In this manner, the housing type outer case of the ink jet recording apparatus is formed with the upper side thereof being open.

On the bottom end of the bottom plate 56, a total of three cylindrical bottom stays are caulking, one on the front part and two in the rear part in FIG. 1, and when being penetrated through the extrusions (not shown) of threading portion of the main body printing machine, it becomes possible to fix them by means of screws. Further, on the bottom portion, an elongated hole (not shown) is arranged to make positioning possible with respect to the main body printing machine in cooperation with the front bottom stay 60A.

Also, the ink jet recording apparatus is provided with spaces for carrying two kinds of recording mediums.

One of them is a carrying space as given below. Above the front plate 53, an L-letter angled resist plate 57 is fixed by means of screws to be laid across the left and right side plates 54 and 55. The envelope which is a printing medium of the main body printing machine is nipped between the upper face of the envelope carrying belt of the main body printing machine and the lower face of the resist plate, and carried from the left to the right in FIG. 1 along inside the curved portion of the resist plate 57.

The other one of them is a carrying space as given below. As shown in FIG. 2, the passage that connects the recessed portion 54A on the central part of the left side plate 54 with the square window 55A of the right side plate 55 shown in FIG. 1 is the space where a gutter is arranged to carry the continuous paper sheet. Although not shown, the gutter is arranged at the leading end of the continuous paper sheet carrying unit having storage and carrying system provided for the continuous paper sheet. With the positioning dowel formed on the leading end of the gutter, which is inserted into the positioning hole formed on the right side plate 55, the ink jet recording apparatus and the continuous paper sheet unit are positioned definitely, and integrated when fixed to the left side plate 54 by means of screw.

On the outer side of the right side plate 55 on the extended line of the leading end of the gutter, a cutter (not shown) is installed for use of the continuous paper sheet. The opening 55B of the right side plate 55 is a hole through which the cutter unit driving motor is carried.

Now, the carriage unit will be described.

The carriage 200 that enables the recording head 400 to travel to the two kinds of carrying spaces described earlier is slidably supported by the CR shaft 202 and CR rail 203 fixed to the right side plate 55 to make reciprocal operation possible by transmitting the driving power of the CR motor 206 to the CR belt 208 fixed to the carriage 200.

Next, the ink supply unit will be described.

On the left side in FIG. 1 and FIG. 2, that is, on the upstream side of the recording medium conveyance, a tank holder unit 10 is installed to contain a large capacity ink tank 501 as an ink supply system for supplying ink to the recording head 400 that discharges ink. To the tank holder unit 10, tubes 210 are connected for leading out ink from the ink tank 501 to the recording head 400.

Next, the recovery unit will be described.

On the right side in FIG. 1 and FIG. 2, that is, on the downstream side of the recording medium conveyance, and between the two kinds of recording spaces described earlier, the recovery unit 300 is installed to recover defective discharges of the recording head 400. The waste ink that has been used for recovering such defects is expelled to the waste ink pool arranged for the main body printing machine through the lower hole (not shown) of the recovery unit that opens to the bottom plate 56.

Next, the control unit will be described.

The control unit is formed by a control board 80 that controls the systems of the ink jet recording apparatus, which is fixed appropriately to the inner rear side of the box-type frame unit described above. Also, The control board 80 is provided with a connector 81 connected with the main body printing machine to receive signals therefrom. Further, a cable 91 is connected with the carriage 200 and the control board 80 to transmit control signals from the control board 80 to the recording head 400 in the carriage 200.

Between the control board 80 and the tank holder unit 10, a power-supply unit 90 is fixed. The power-supply receptacle of the power-supply unit 90 is installed on the square hole 54B open to the left side plate 54 to receive power supply from the outside, which is connected from the outer side of the frame unit. The power-supply unit 90 is wired so as to supply electric power to the control board 80 and a base board (not shown) on the carriage 200.

Now, in conjunction with FIG. 3 to FIG. 7, the description will be made of the tank holder unit 10 further in detail.

Figure 3:
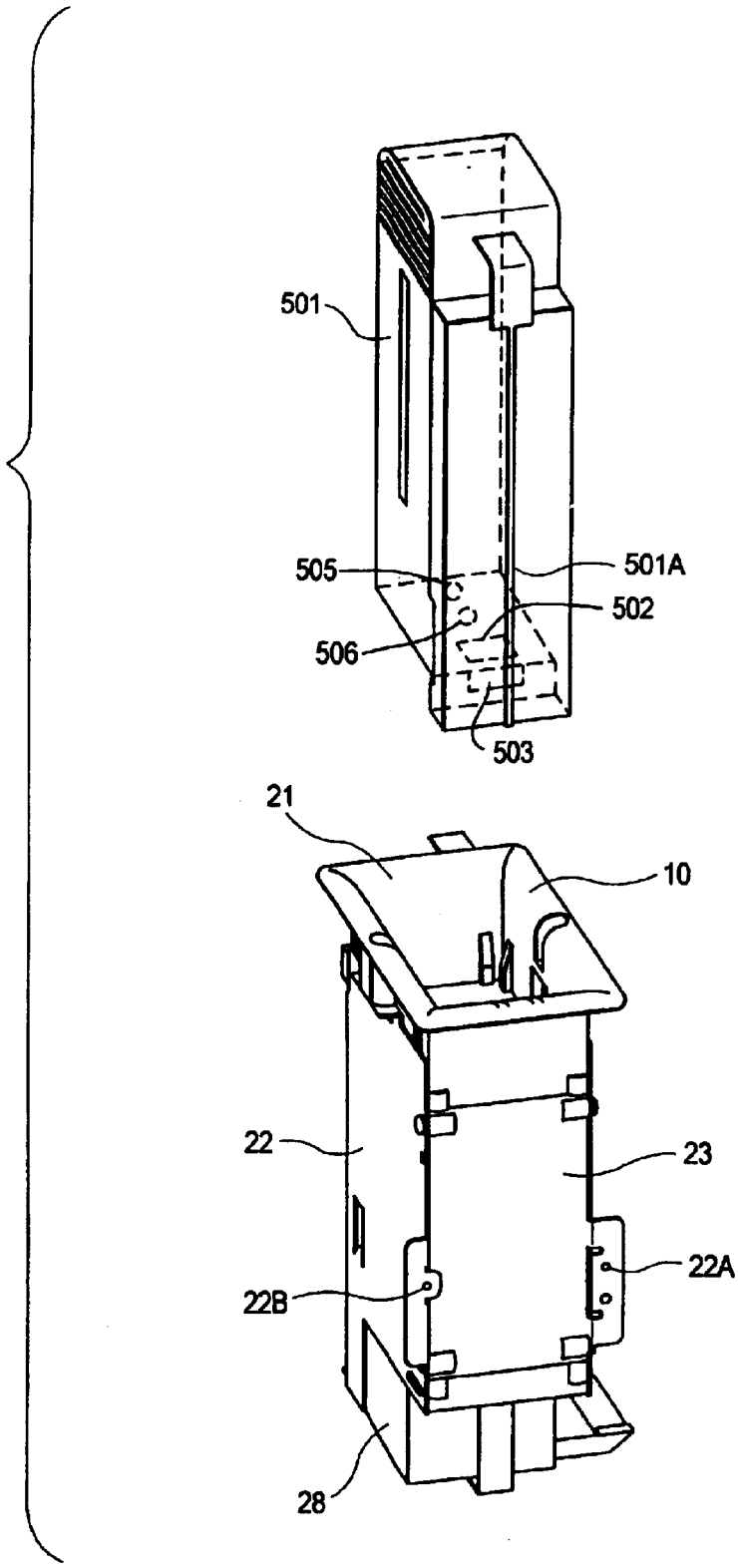
FIG. 3 is a perspective view which shows the tank holder unit shown in FIG. 1 and FIG. 2, and the ink tank which is mounted thereon.

FIG. 3 is a perspective view which shows the tank holder 10 represented in FIG. 1 and FIG. 2, and the ink tank 501 connected thereto.

The tank holder unit 10 fixes the installed ink tank 501 to supply ink to the recording head on the recording apparatus main body. The ink tank 501 is a hollow and airtightly closed container that retains ink injected into the interior thereof. On the lower part of the ink tank 501 in the gravitational direction, an ink supply port (not shown) is formed and sealed with a rubber plug or the like. On the side face of the ink tank 501, a guide rib 501A is arranged to guide it when it is inserted into the tank holder unit 10.

The tank holder unit 10 is formed with a tank slot 21 serving as the tank insertion inlet; a tank rail 23 provided with the guide rail (not shown) which is located to face the guide rib 501A of the ink tank 501 and position the tank by nipping the guide rib 501A for conduction; and a buffer tank 28 serving as the insertion abutting member for the ink tank 501, which are arranged integrally by use of the box-type tank holder 22 that contains the ink tank 501. Then, the tank holder unit 10 is fixed to the chassis (not shown) of the apparatus main body by means of the threaded holes 22A and 22B.

Figure 4:
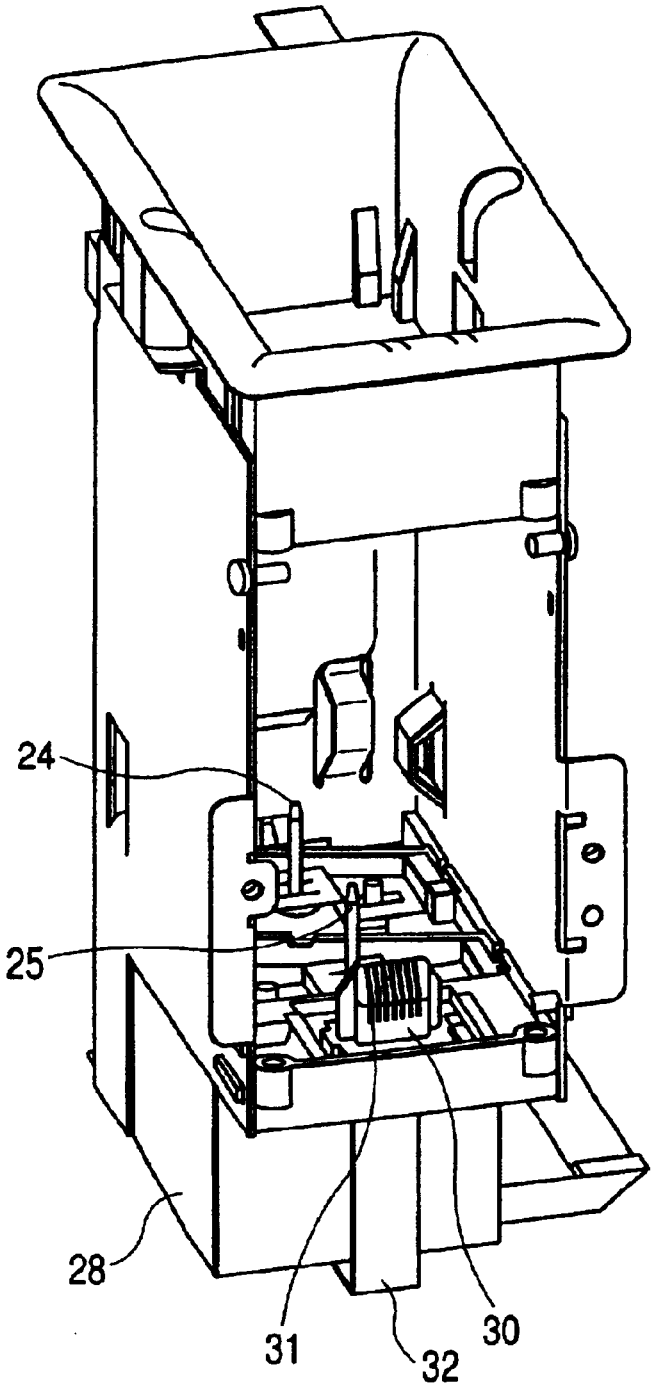
FIG. 4 is a perspective view which shows the inner structure of the tank holder unit represented in FIG. 3.
Figure 5:
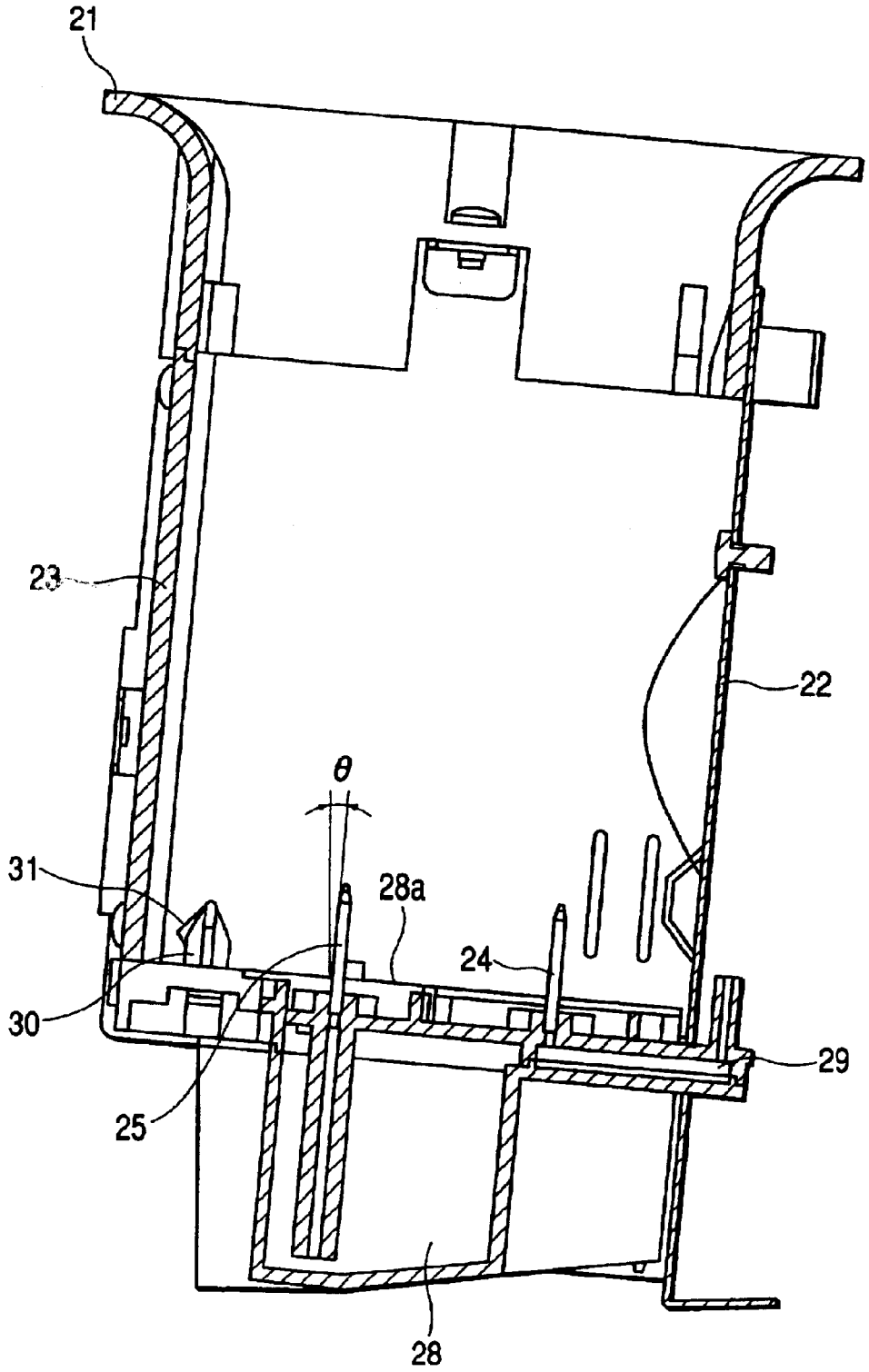
FIG. 5 is a cross-sectional view which shows the inner structure of the tank holder unit represented in FIG. 3, observed from the side end thereof.

FIG. 4 is a view which shows the interior of the tank holder unit 10 by removing the tank rail 23. FIG. 5 is a cross-sectional view which shows the inner structure of the tank holder unit, observed from the side end.

On the portions to face the ink supply port (not shown) and the atmospheric communication port (not shown) of the ink tank 501, respectively, inside the tank holder unit 10, hollow needles 24 and 25 are arranged to be penetrated through the rubber plugs (not shown) provided for the ink supply port and atmospheric communication port of the ink tank, respectively. Each tip of the hollow needles 24 and 25 is pointed to make it easier to penetrate the facing rubber plug. Near the tip of hollow needle, an opening is arranged through which ink in the ink tank 501 is supplied to the recording head 400 installed in the recording apparatus main body. The foot end of hollow needle 24 is fixed to the buffer tank 28, and connected with the recording head 400 by way of the flow path 29 fanned by the buffer tank 28 and tubes (not shown). Also, the foot end of hollow needle 25 is connected with the buffer tank which has a hollow chamber in it. On the upper portion of the rear chamber, there is a small hole (not shown) open for releasing the air. With the structure thus arranged, ink injected into the ink tank 501 is supplied to the recording head 400 through the hollow needle 24, in parallel with which the air outside is supplied into the ink tank 501 through the hollow needle 25 to be replaced with ink. In this manner, ink in the tank is consumed sufficiently.

As shown in FIG. 5, the rear needles 24 and 25 are substantially perpendicular to the installation surface thereof (ink tank mounting surface 28*a*. The inserting direction of the tank into the tank holder unit 10, and the connecting direction of the hollow needles 24 and 25 bare set at $\theta$=3.8° to the gravitational direction (vertical direction) or, preferably, 5°. The hollow needle 24 serving as the ink outlet prot is positioned lower than the hollow needle 25 in the gravitational direction.

At a position on the side face of the ink tank 501, which is side by side with the ink supply port almost in series, a memory device 502 and an electric base board 503 having peripheral circuits therefor are arranged as an information holding unit provided with information characteristic of the ink tank having been written thereon. The electric base board 503 is a component of electrical conduction. On the bottom face in the tank holder unit 10, a connector 30 is installed to transmit the ink tank information to the recording apparatus main side by being in contact with the terminals of the aforesaid electric base board. The corresponding bottom face of the ink tank 501 includes an ink supply port 505 and an air supply port 506.

Figure 6:
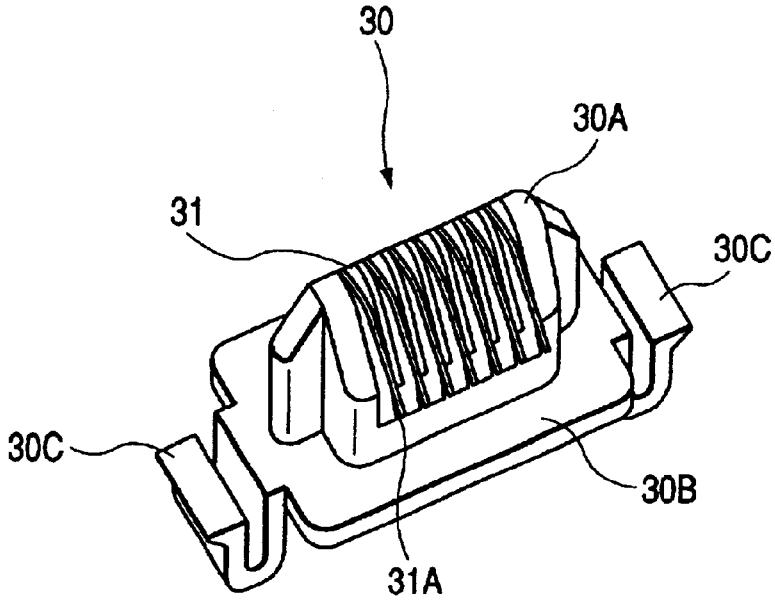
FIG. 6 is a view which shows the front shape of the connector represented in FIG. 4 and FIG. 5.

Further, in conjunction with FIG. 6 and FIG. 7, the description will be made of the configuration of the connector 30 which is used for the present invention.

The connector 30 is provided with a base unit 30B which is installed on a mounting portion (not shown) of the buffer tank 28 to be movable in the plane direction. On both ends of the base unit 30B, the nail portions 30C are formed, respectively, to regulate the movement of the upper part of the connector 30 when incorporated on the mounting portion on the buffer tank 28, thus implementing the function to prevent it from falling off. On the surface of the base unit 30B (the surface of tank installation side), a tank insertion unit 30A is formed. The leading end of the tank insertion unit 30A is tapered.

On the side face of the tank insertion unit 30A on the side opposite to the hollow needle 24 serving as the ink outlet port, there are arranged several contacts 31 formed by elastic material (see FIG. 6), and configured to be easily inserted into the tank with the provision of tapered leading ends in the same manner as the tank insertion unit 30A. The contact unit 31A which serves as electrically conductive portion is allowed to be in contact with the terminals of the aforesaid electric base board on the tank 501 side in an elastically deformed condition.

Figure 7:
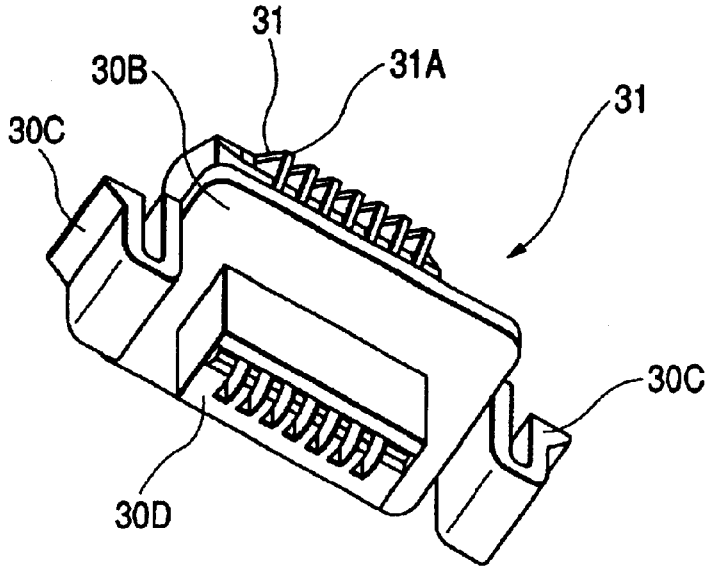
FIG. 7 is a view which shows the backside shape of the connector represented in FIG. 4 and FIG. 5.

On the back side of the base unit 30B (the face on the side opposite to the tank installation side), a cable insertion unit 30D is arranged (see FIG. 7). By use of the flat cable 32 which is inserted into it, the ink tank information is transmitted to a controller (not shown) provided for the recording apparatus main body.

Particularly, as shown in FIG. 5, the ink tank mounting surface 28*a* where the connector 30 is installed is positioned higher than the fixing position of the hollow needle 24 serving as the ink outlet port in the gravitational direction. In this way, even if ink should leaks from the hollow needle 24, ink is not allowed to flow toward the connector 30. Then, the alignment of plural contacts 31 of the connector 30 is directed to intersect with the arrangement direction of the hollow needle 24 and connector 30 or preferably, directed to be orthogonal to it. Also, the contacts 31 are supported on the side face which is opposite to the side where the hollow needle 24 is arranged as the ink outlet port. In other words, between the plural contacts 31 and the hollow needle 34 serving as the ink outlet port, the tank insertion unit of the connector 30, which supports the contacts 31, lies as a wall which blocks ink spreads or the like when ink tank is attached or detached.

As described above, in accordance with the present invention, it is structured to arrange the information holding unit that stores the contents characteristic of the ink tank installed on the detachably mountable ink tank holder, and the alignment of plural contacts of the connector which is electrically in contact with it to transmit the information characteristic of the ink tank to the recording apparatus main body so as to enable this alignment is directed to intersect with, or preferably orthogonal to the arrangement direction of the ink outlet port and the connector. Then, with the contact supporting member of the connector that fixes the contacts as reference, the contacts are positioned on the side opposite to the ink outlet port, hence making it possible to secure the reliability of contacts without allowing the contacts to be affected by ink splash or the like when an ink tank is attached to or detached from the apparatus main body.

Also, with the connector positioned higher than the ink outlet port in the gravitational direction, it becomes possible to implement the formation of structure which prevents defective contacts or short circuits from being caused by ink flow toward the connector even if ink leakage should occur from the ink outlet port.

What is claimed is:

1. An ink jet recording apparatus to which an ink tank is removably mountable, the ink tank being provided with a component of electrical conduction and an ink supply port, said ink jet recording apparatus for recording by discharging ink supplied from the ink tank from an ink jet recording head, said ink jet recording apparatus comprising:

a mounting surface for mounting the ink tank;

a connector arranged at a first position of said mounting surface, said connector being provided with an electrical contact electrically conductible with the component of electrical conduction of the ink tank when mounted on said mounting surface, and an electrical contact supporting unit on said connector for supporting said electrical contact; and an ink outlet port arranged at a second position of said mounting surface, said ink outlet port being communicated with the ink supply port of the ink tank when mounted on said mounting surface;

wherein said electrical contact is positioned on said electrical contact supporting unit so that said electrical contact supporting unit shields electrical contact with the component of electrical conduction of the ink tank from ink from said ink outlet port.

2. An ink jet recording apparatus according to claim 1, wherein said electrical contact is arranged in plural numbers in a direction intersecting with a line between said electric contact and said ink outlet port.

3. An ink jet recording apparatus according to claim 1, wherein said ink jet recording head discharges ink supplied from the ink tank using thermal energy generated by electrothermal converting elements.

4. An ink jet recording apparatus according to claim 1, wherein said ink jet recording head discharges ink supplied from the ink tank using energy generated by piezoelectric elements.

5. An ink jet recording apparatus according to claim 1, wherein the component of electrical conduction facilitates electrical transmission of information between an information holding unit for holding information characteristic of the ink tank, and said ink jet recording apparatus.

6. An ink jet recording apparatus according to claim 1, wherein said mounting surface is inclined relative to a horizontal direction in an in-use position, and in the in-use position, said first position is higher than said second position.

* * * * *

UNITED STATES PATENT AND TRADEMARK OFFICE

CERTIFICATE OF CORRECTION

PATENT NO. : 6,742,872 B2
DATED : June 1, 2004
INVENTOR(S) : Hideo Fukazawa et al.

It is certified that error appears in the above-identified patent and that said Letters Patent is hereby corrected as shown below:

Column 1,
Line 16, “an” should read -- a --; and
Line 25, “each amount of contents” should read -- content amount of each --.

Column 2,
Line 37, “for” should read -- on --.

Column 4,
Line 10, “caulking” should read -- provided --.

Column 6,
Line 3, “fanned” should read -- formed --;
Line 17, “bare” should read -- are --; and
Line 20, “prot” should read -- port --.

Column 7,
Line 3, “leaks” should read -- leak --;
Line 14, “spreads” should read -- spread --;
Line 23, “is” should read -- to be --; and
Line 24, “preferably orthogonal” should read -- preferably be orthogonal --.

Signed and Sealed this

Thirtieth Day of November, 2004

JON W. DUDAS
*Director of the United States Patent and Trademark Office*